United States Patent [19]

Willis

[11] 4,204,140

[45] May 20, 1980

[54] SAFETY CIRCUIT FOR ELECTRONIC FLASH APPARATUS

[75] Inventor: Roger L. Willis, Churchville, N.Y.

[73] Assignee: Eastman Kodak Company, Rochester, N.Y.

[21] Appl. No.: 11,451

[22] Filed: Feb. 12, 1979

[51] Int. Cl.[2] ..... H05B 41/32

[52] U.S. Cl. ..... 315/241 P; 315/151; 315/362; 328/7; 354/145

[58] Field of Search ..... 315/151, 159, 241 P, 315/362; 320/1; 328/7; 354/127, 145, 288

[56] References Cited

U.S. PATENT DOCUMENTS

| | | | |
|---|---|---|---|
| 2,969,721 | 1/1961 | Casselman et al. | 354/145 |
| 3,383,994 | 5/1968 | Bihlmaier | 354/145 X |
| 3,555,394 | 1/1971 | Bramer et al. | 307/157 X |
| 3,666,964 | 5/1972 | Flynn | 320/1 X |
| 3,705,540 | 12/1972 | Reed et al. | 354/145 X |
| 3,723,810 | 3/1973 | Mashimo | 354/145 X |
| 3,890,538 | 6/1975 | Iwata et al. | 315/241 P |
| 3,921,034 | 11/1975 | Nakamura | 315/241 P |
| 3,969,737 | 7/1976 | Kendrick | 354/141 |
| 4,025,817 | 5/1977 | Wollschleger | 315/241 P |
| 4,095,141 | 6/1978 | Nakamura | 315/241 P |

*Primary Examiner*—Eugene R. LaRoche
*Attorney, Agent, or Firm*—D. P. Monteith

[57] ABSTRACT

An electronic flash unit has a safety circuit for removing stored electrical energy that is potentially hazardous to a flash unit user. A switch, responsive to opening of the flash unit housing, is closed to energize a quench circuit, which is parallel to a chargeable flash firing capacitor. The firing capacitor discharges through the quench circuit, thereby lowering the stored electrical energy to a level that is not hazardous to an operator.

9 Claims, 7 Drawing Figures

42,44
41,45
43
110
111
116
62
63
A
114a
114
114b
114c
115
54
58
100
102
56
50
104
106
107
69
117
121
120
122
128
124
126
68
67
64
66
139
SENSING LEVER
138
136
135
70a
70
SHUTTER
78
12

CAPACITANCE (MICROFARADS)
1000
900
800
700
600
500
400
300
200
250
300
350
400
450
CAPACITOR VOLTAGE
131
THRESHOLD OF LETHAL HAZARD

SAFETY CIRCUIT FOR ELECTRONIC FLASH APPARATUS

BACKGROUND OF THE INVENTION

1. Field of the Invention

This invention relates to a quenchable electronic flash unit having a safety circuit for eliminating any danger of electrical shock or injury to a flash unit user. More particularly, this invention relates to a safety circuit which employs a quench circuit of the flash unit to discharge a flash firing capacitor.

2. Description of the Prior Art

Electronic flash units typically employ a large capacitor having a capacitance between about 200 and 800 microfarads (uf), for storing electrical energy that is used for firing a flashtube. A DC to DC coverter circuit, which is energized from a low voltage battery (approximately 6 volts), charges the capacitor in a known manner to approximately 300 volts. A capacitor having a capacitance C charged to a voltage V stores electrical energy equal to $\frac{1}{2}$ $CV^2$. Thus, a 400 microfarad capacitor, charged to 300 volts, stores 18 joules of energy. If a flash unit user, in tampering with or trying to repair the unit, were to contact the terminals of a charged flash firing capacitor, discharge current from the capacitor could produce serious injury.

It is known for electronic flash units to include a safety circuit for discharging the firing capacitor to protect users against injury. For example, U.S. Pat. Nos. 3,666,964, 3,969,737 and 4,025,817 disclose electronic flash units having a circuit the sole purpose of which is to discharge a firing capacitor to prevent accidental injury to a user. These circuits generally include a normally open switch in series with a bleeder resistor, the switch and resistor being connected parallel to the firing capacitor. The switch is closed automatically whenever the housing of the flash unit is opened, thereby discharging the firing capacitor through the switch and the resistor. Although a circuit of this type has been found to operate reliably, both the switch and the bleeder resistor must be able to handle the high discharge current from the firing capacitor. Furthermore, both the resistor and switch are required solely as a safety feature, and therefore introduce additional complexity and cost into the flash unit.

SUMMARY OF THE INVENTION

According to the present invention, an electronic flash unit includes a safety circuit for automatically discharging stored, potentially hazardous electrical energy in situations where a user may come into contact with the stored energy, such as during a flash repair operation.

The flash unit includes a flashtube energizable for producing light, and a dischargeable firing capacitor for producing a discharge current to energize the flashtube. An energizable flash quench circuit is coupled to the firing capacitor and, in response to energization of the quench circuit, diverts the discharge current from the flashtube to terminate the flashtube light. A safety circuit includes a switch, coupled to the quench circuit, having (1) a first condition, and (2) a second condition in which the quench circuit is energized. A flash housing member is movable relative to the safety switch between (1) a first position in which the switch is maintained in its first condition, and (2) a second position in which the switch is moved to its second condition thereby energizing the quench circuit for discharging the firing capacitor.

The invention and its objects and advantages, will become more apparent in a detailed description of a preferred embodiment presented below.

DESCRIPTION OF THE DRAWINGS

In a detailed description of a preferred embodiment of the invention presented below, reference is made to the accompanying drawings, in which.

DESCRIPTION OF A PREFERRED EMBODIMENT

Because cameras and electronic flash units are well known, the present description will be directed in particular to elements forming part of, or cooperating more directly with, apparatus in accordance with the present invention. It is to be understood that camera and flash unit elements not specifically shown or described may take various forms well known to those having skill in the art.

Figure 1:
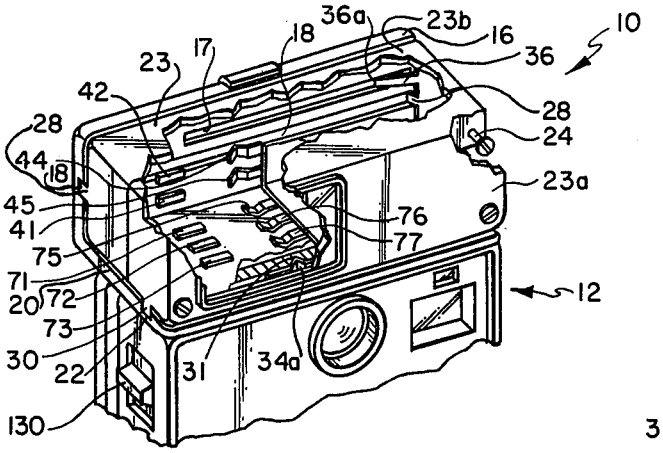
FIG. 1 is a perspective view of an upper portion of a camera having an electronic flash unit mounted on the top of the camera in a flash OFF position, portions of the flash unit and the camera being broken away to illustrate structure for mounting and electrically coupling the flash unit to the camera.
Figure 2:
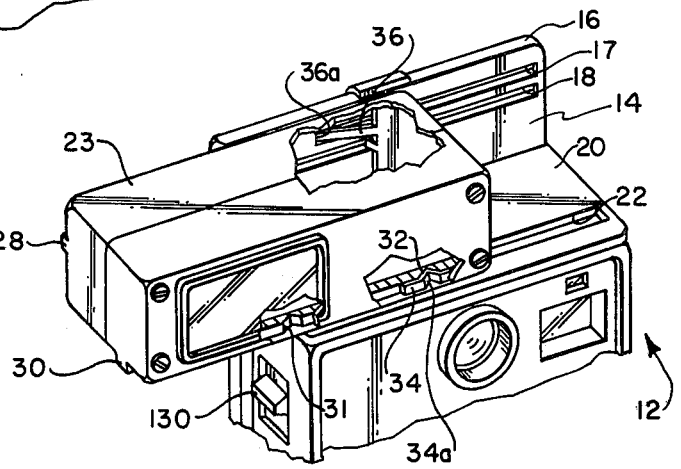
FIG. 2 is a perspective view of an upper portion of the camera having the electronic flash unit mounted on the top of the camera in a flash ON position.

An electronic flash unit 10 is mounted for slidable movement across the top of a photographic camera 12 between an OFF position, shown in FIG. 1, in which the flash unit is de-energized, and an ON position shown in FIG. 2, in which the flash unit is energized. Attached to the top of the camera 12 is a generally right-angled bracket member 14 for supporting the flash unit 10. An upstanding leg portion 16 of the member 14 includes a pair of vertically-spaced parallel grooves 17 and 18. A horizontally directed base portion 20 of the member 14 includes an elongate groove 22 (see FIG. 2) which is parallel to grooves 17 and 18. As can be seen in FIG. 1, the grooves 18 and 22 are open end at the left-hand edge of the member 14, as viewed in the drawing.

A housing 23 of the flash unit 10 includes a front housing **23*a* and a back housing 23*b* shaped complementary with respect to the front housing. The front housing 23*a* is releasably connected to the back housing 23*b* by suitable means such as elongate screws 24**, which are screwed into threaded holes 25 (see FIG. 7) associated with the back housing.

Integral with the back of housing 23*b* and the bottom of housing 23*a* are elongate ribs 28 and 30, respectively. The ribs 28 and 30 are slidably located within the grooves 18 and 22, respectively, to form a mating pair of tongue and groove joints. These joints serve to retain the flash unit 10 on the top of the camera 12 and guide the unit 10 for movement over a range of operative positions defined at one end by the flash OFF position (FIG. 1) and the other end by the flash ON position (FIG. 2).

A pair of spaced notches 31 and 32 are formed in the frontwardly facing side of the rib 30. Located within a niche (not shown) along the frontmost side of the groove 22 is an elongate leaf spring 34, which includes a v-shaped detent 34*a*, the apex of which is adjacent the frontmost side of the rib 30. The flash unit 10 may be positively located in its ON or OFF position by the seating of detent 34*a* in notch 32 or 31, respectively. In operative positions between the ON and OFF positions, the rib 30 flexes the detent 34*a* into the groove 22 to allow the flash unit 10 to be moved without obstruction.

A cantilevered member 36 is attached to the back of the housing 23*b* and is slidably located in the groove 17. When the flash unit 10 is in its ON position the free end 36*a* of the member 36 is caught in the left-end corner, as viewed in the drawing, of the groove 17 (FIG. 2) to secure the unit 10 from being moved further to the left beyond its ON position and to thereby prevent inadvertent removal from the camera 12.

In order to remove the flash unit 10 intact from the camera 12, a flash unit user inserts a card such as a postcard between the leg portion 16 and the back of the housing 23*b* of the unit 10 to flex the free end 36*a* of the member 36 out of the groove 17. The housing 23 of the flash unit 10 may then be slid to the left, as viewed in FIGS. 1 and 2, off the bracket member 14.

Figure 3:
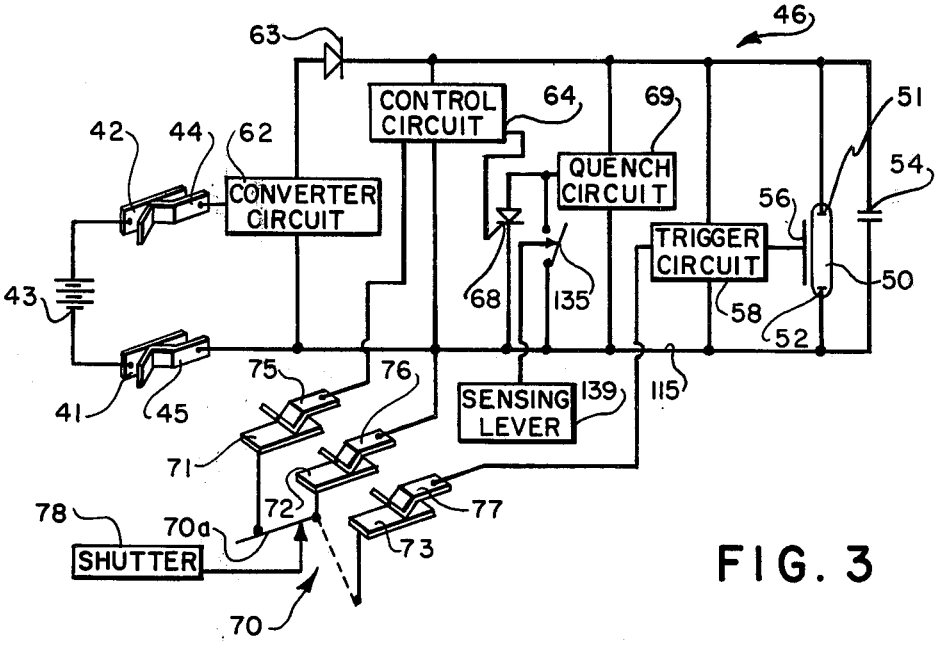
FIG. 3 is a schematic, primarily in block diagram form, of electronic circuitry included in the flash unit shown in FIGS. 1 and 2, the circuitry including a safety circuit for preventing electrical injury to an operator of the flash unit.
Figure 4:
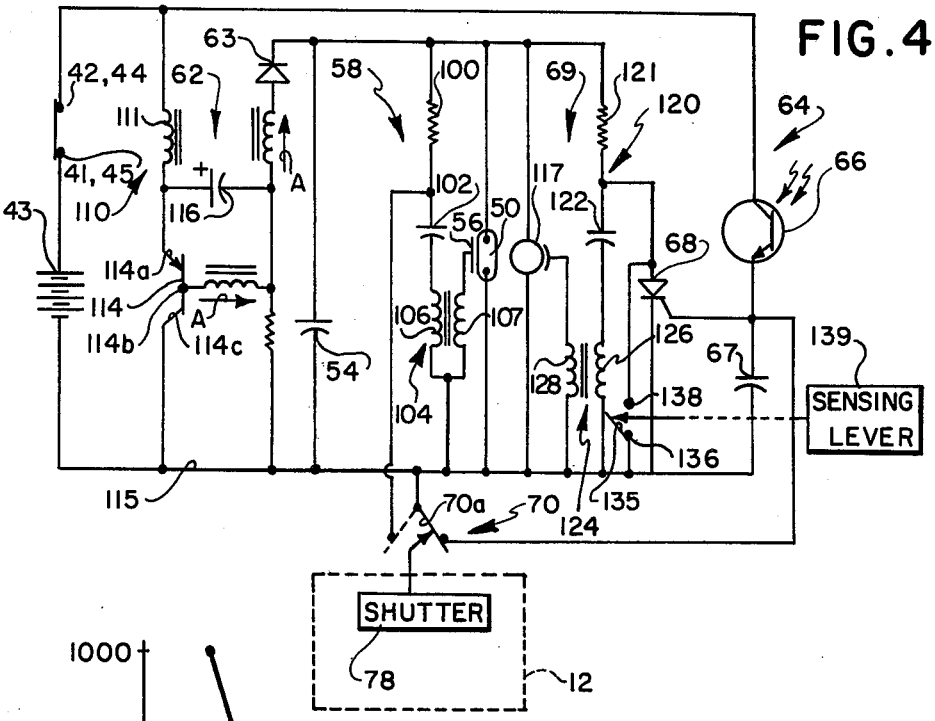
FIG. 4 is a circuit diagram of the electronic circuit of FIG. 3.

As shown in FIG. 1, a pair of electrical contacts 41 and 42 is located on the upstanding leg portion 16 of the member 14 and is connected to a low voltage battery 43, shown in FIGS. 3 and 4. Preferably the battery 43 is located in the camera 12. Attached to the back of the housing 23*b* for movement with the flash unit 10 is a pair of electrical contacts 44 and 45, which are connected to an electronic flash circut 46, shown primarily in block diagram form in FIG. 3. When the flash unit 10 is in its ON position, the contacts 44 and 45 engage the camera contacts 42 and 41 respectively, to thereby connect the battery 43 to the circuit 46.

The circuit 46 includes a flashtube 50 filled with an ionizable gas such as xenon. The flashtube 50 has a pair of main current conducting electrodes 51 and 52, which are connected to opposite terminals or contacts of a dischargeable flash-firing capacitor 54. The capacitor 54, which has a capacitance on the order of approximately 800 microfarads, provides a high amplitude discharge to fire the flashtube 50 to produce a given quantity of light. A trigger electrode 56 is located adjacent, but external the flashtube 50, and is connected to an energizable flash trigger circuit 58. The trigger circuit 58 provides a trigger voltage on trigger electrode 56 that initiates ionization of the gas in the flashtube 50. When the gas is ionized, interelectrode resistance of the flashtube 50 is reduced abruptly and the capacitor 54 discharges through the flashtube to produce the aforementioned light quantity.

To obtain a voltage that is adequate for firing the flashtube 50, a voltage converter circuit 62 is provided to step-up or convert the relatively low voltage of the battery 43 to a voltage sufficient to charge the capacitor 54. The converter 62 provides a pulsed output current for charging the capacitor 54. Positive pulses of this charging current are conducted through a diode 63, the anode of which is connected to the output of the converter.

A control circuit 64 constitutes means for energizing a quench circuit 69 in response to the occurrence of a predetermined exposure parameter, such as a desired exposure. Control circuit 64 produces a predetermined voltage, referred to hereinafter as a flash terminating signal, to turn an electronic switch, such as an SCR 68, ON. A quench circuit 69, which constitutes means for terminating the production of light by the flashtube 50, is energized in response to conduction of the SCR 68. When energized, the quench circuit 69 serves effectively as a short-circuit across the flashtube 50. Accordingly, the discharge current from the capacitor 54 is diverted from the flashtube 50 and flows through the quench circuit 69, thereby causing the flashtube to be quenched.

An actuatable double throw "x-contact" synchronization switch 70 for energizing the trigger circuit 58 includes a movable switch arm 70*a*, three electrical contacts 71, 72 and 73 located on the top surface of the base portion 20 of the member 14, and three corresponding electrical contacts 75, 76, and 77, attached to the bottom of the housing 23 of the flash unit 10 for slidable movement therewith. The contacts 75, 76, and 77 engage the contacts 71, 72, and 73, respectively, of the synchronization switch 70 when the flash unit 10 is in its ON position. The switch arm 70*a* has a normal deactuated position, shown by the solid line of FIG. 3, in which the pair of contacts 71 and 75 are electrically connected to the pair of contacts 72 and 76. In its deactuated position, the switch 70 effectively short circuits the control circuit 64 for a reason made apparent hereinbelow.

The switch arm 70*a* has an actuated position, shown by the dashed line of FIG. 3, in which the pair of contacts 72 and 76 is connected to the pair of contacts 73 and 77. The switch arm 70*a* is moved from its normal, deactuated position to its actuated position in response to opening movement of a camera shutter 78. As the switch 70 moves from its deactuated position, the control circuit 64 is turned ON. WHen the switch 70 is in its actuated position, the flash trigger circuit 58 is energized, to thereby fire the flashtube 50.

The elements of circuit 46 thus far described are part of conventional electronic flash apparatus commonly known as a quench-type electronic flash unit or a quenchable electronic flash unit.

A schematic diagram of the circuit 46 is shown in FIG. 4. The trigger circuit 58 includes a resistor 100, a trigger capacitor 102 of relatively small capacitance on the order of 0.04 microfarad, and a trigger transformer 104, a primary winding 106 of the transformer, the resistor, and the trigger capacitor forming a series circuit, which is parallel to the flashtube 50. The trigger transformer 104 has its secondary winding 107 connected in series to the trigger electrode 56, as shown.

The converter circuit 62 includes a transformer 110, having a primary winding 111 and a secondary winding comprising a high voltage winding 112 and a low voltage winding 113. An oscillating transistor 114 has its emitter electrode 114a connected to the primary winding 111, as shown, base electrode 114b is connected in series to the low voltage winding 113 and collector electrode 114c is connected to return line 115, which is electrically grounded. A control capacitor 116 is connected in parallel across the emitter-base junction of the transistor 114 and winding 113, as shown, and operates to provide positive feedback of the base electrode current to the emitter electrode 114a.

In a preferred embodiment, the control circuit 64 is constituted by a light-responsive integrating circuit comprising a photosensitive element, such as a phototransistor 66 which is located to receive light preferably reflected from a scene being photographed, and an integrating capacitor 67 connected in series with the phototransistor. When the switch 70 is in its deactuated position, it short-circuits the capacitor 67, thereby preventing the control circuit 64 from responding to any light before the shutter 78 opens. When the switch 70 moves from its deactuated position, the capacitor 67 commences to integrate the current flowing through the phototransistor 66 and when the capacitor is charged to a predetermined voltage representing a desired exposure, the flash terminating signal is produced to turn the SCR 68 ON.

The quench circuit 69 includes an energizable quench tube 117, parallel to the flashtube 50. A quench trigger circuit 120, connected to the SCR 68, consists of a resistor 121, a quench trigger capacitor 122 of relatively small capacitance also on the order of 0.04 microfarad, and a quench trigger transformer 124. A primary winding 126 of the quench transformer 124, the resistor 121, and the quench trigger capacitor 122 are connected together to form a series circuit parallel to the flashtube 50. The quench transformer 124 has its secondary winding 128 connected in series to a trigger electrode 129 of the quench tube 117, as shown.

The converter 62 operates as follows. When the electronic flash unit 10 is in its ON position, current is caused to flow from the battery 43 through the primary winding 111. Initially, the portion of the battery voltage which appears across the primary winding 111 is relatively small and only a slight amount of current is caused to flow both into the emitter electrode 114a and to charge the capacitor 116. The voltage across the primary winding 111 induces a voltage across the secondary windings 112 and 113 under the influence of the transformer 110 and current is caused to flow through each of the secondary windings in the direction of the arrows, denoted A. As this occurs, a portion of the current through the winding 113 is fed back through the capacitor 116 and into the emitter electrode 114a. As this happens, the oscillating transistor 114 is rapidly driven into saturation and the voltage across the primary winding 111 approaches a constant equal approximately to the battery voltage. For this condition to be maintained, current must be drawn from the battery 43 that increases linearly in amplitude. Battery current can be increased linearly only for a brief duration, because peak battery current is limited. During the time that battery current is increasing the capacitor 116 is charged with a polarity as shown, and a high voltage pulse is produced across the winding 112. This pulse conducts through the diode 63 and charges the firing capacitor 54, the trigger capacitor 102, and the quench trigger capacitor 122.

Once battery current ceases to increase, the flux field produced by the primary winding 111 collapses, and thereby a voltage of opposite sense is instantaneously induced across the secondary windings 112 and 113 of the transformer 100. When this happens, it is necessary, in order to fully understand the operation of the converter circuit 62, to consider two conditions which occur. First, because the anode of the diode 63 is connected to the winding 112, the diode is reverse biased by this induced voltage and does not conduct. Secondly, the capacitor 116 discharges through the transistor 114, thereby causing base electrode current to again flow through the secondary winding 113 in the direction of arrow A. As this happens, positive feedback again occurs through the capacitor 116 and the aforementioned operation of the converter 62 is repeated. The net result is that an alternating series of positive and negative pulses is produced across the winding 112. The positive pulses turn the diode 63 ON and charge the firing capacitor 54, the trigger capacitor 102, and the quench capacitor 122. The pulse rate is selectively controlled by the value of the elements of the converter circuit 62, and the capacitors 54, 102 and 122 are each charged to approximately 300 volts.

Assuming that the electronic flash unit 10 is in its ON position and the firing capacitor 54 is charged sufficiently to fire the flashtube 50, the circuit 46 operates as follows. A camera shutter release button 130 (FIGS. 1 and 2) is actuated to effect opening movement of the camera shutter 78. This shutter movement causes the switch 70 to move from its normal position wherein the integrating capacitor 67 is short circuited, to its actuated position, wherein the trigger capacitor 102 is connected to return line 115 through the switch arm 70a. When the switch 70 moves from its normal position, the integrating capacitor 67 commences to charge in response to current flowing through the phototransistor 66. That current represents the illumination impinging on the phototransistor 66. A camera having an electronic flash and a mechanical switch, responsive to opening movement of a camera shutter, for synchronously activating flash light-integrating circuitry and energizing the flash is disclosed in Research Disclosure Article No. 16660, published February 1978, the disclosure of which is incorporated herein by reference.

When the switch 70 reaches its actuated position, the trigger capacitor 102 discharges through the switch arm 70a and the primary winding 106. Under the influence of the transformer 104, a high voltage trigger pulse is applied to the trigger electrode 56. This trigger pulse ionizes the gas in the flashtube 50, thereby sharply reducing the interelectrode resistance of the flashtube 50. The firing capacitor 54 then commences to discharge through the flashtube 50 to produce a pulse of light.

When the control circuit 64 senses a predetermined amount of light following actuation of the switch 70, the integrating capacitor 67 is charged to a voltage representing the flash terminating signal. This terminating signal causes the SCR 68 to turn ON. The quench trigger capacitor 122 then discharges through the SCR 68 and the primary winding 126. Under transformer action, a voltage is induced in the secondary winding 128 to cause the quench tube 117 to conduct. The quench tube 117 has a much lower resistance, when conductive, than does the flashtube 50. Accordingly, when the quench tube 117 conducts, the discharge current from the capacitor 54 is diverted from the flashtube 50 and flows through the quench tube, thereby quenching or terminating further light from the flashtube.

Figure 5:
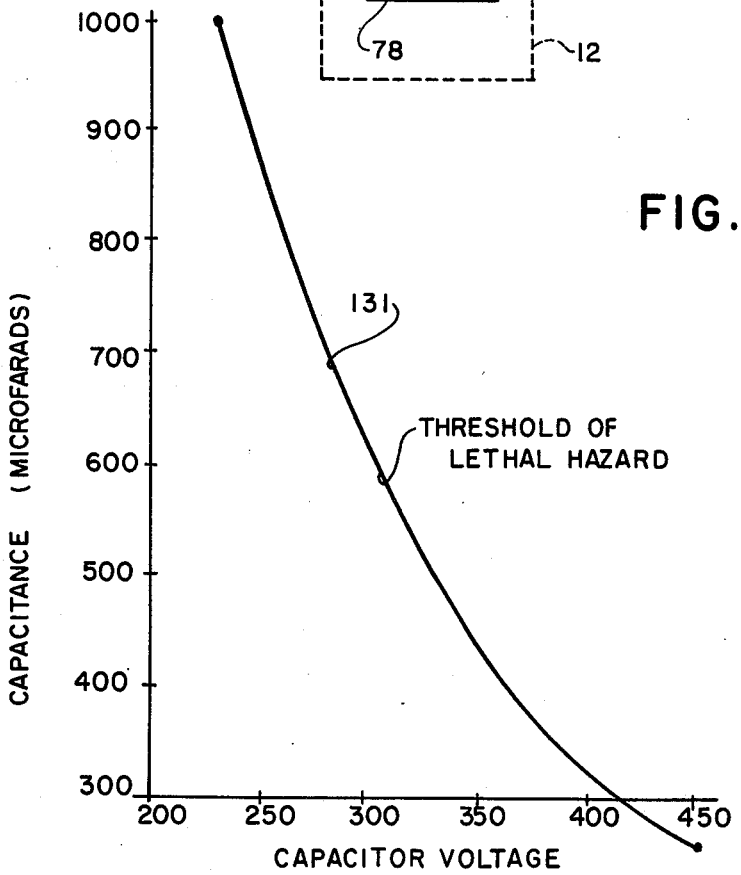
FIG. 5 is a curve for illustrating the combinations of capacitors and capacitor voltages which may produce a pulse of current that is potentially lethal.

The energy stored on a capacitor is equal to $\frac{1}{2}CV^2$. A current produced from energy stored on a capacitor is potentially hazardous if the capacitance of the capacitor and the capacitor voltage are large. The curve 131 of FIG. 5 illustrates combinations of capacitors (capacitance in microfarads), and capacitor voltages that produce a pulse of current, which may be potentially lethal. Any capacitor and voltage combination that is above or to the right of the curve 131, as viewed in the drawing, can produce a lethal current pulse. It can be seen that a firing capacitor, which is on the order of 800 uf, charged to approximately 260 volts stores enough electrical energy so as to produce a potentially lethal current pulse. Smaller combinations of capacitance and voltage can produce a current pulse that can cause other less severe injury.

Because a flash unit user may wish to have access to the interior of the flash unit 10, for example, to replace the flashtube 50, it is desirable to provide means to remove electrical energy stored in the circuit 46 prior to any such access to eliminate the possibility of injury to the user. Any stored energy would be primarily on the firing capacitor 54 since its capacitance is about four orders of magnitude larger than the capacitance of the trigger and quench capacitors.

The front housing 23*a* contains the flashtube 50, and the back housing 23*b* contains the firing capacitor 54. The flashtube 50 is connected to the circuit 46 parallel to the firing capacitor 54 by means of wires 134 (see FIG. 7). It can be appreciated that when the front housing 23*a* is separated from the back housing 23*b*, accessibility of the wires 134 presents a potentially dangerous situation to a user if the firing capacitor 54 is charged.

A safety switch 135, parallel to the SCR 68 (see FIGS. 3 and 4), is provided for discharging the firing capacitor 54 for safety purposes. The safety switch 135 is located in the back housing 23*b* and is mounted for movement between a normal open position, which exists whenever the front housing 23*a* of the flash unit 10 is connected to the back housing 23*b*, and an actuated closed position, which exists when the front housing 23*a* and the back housing 23*b* are separated, as described in detail hereinbelow. When the safety switch 135 is in its closed position, the quench capacitor 122 discharges through the safety switch and the primary winding 126. As is the case when the capacitor 122 discharges through the primary winding 126 in response to the flash terminating signal causing the SCR 68 to turn ON, the quench tube 117 is caused to conduct. The firing capacitor 54 then discharges rapidly through the quench tube 117 to remove potentially harmful energy stored on the firing capacitor.

Figure 6:
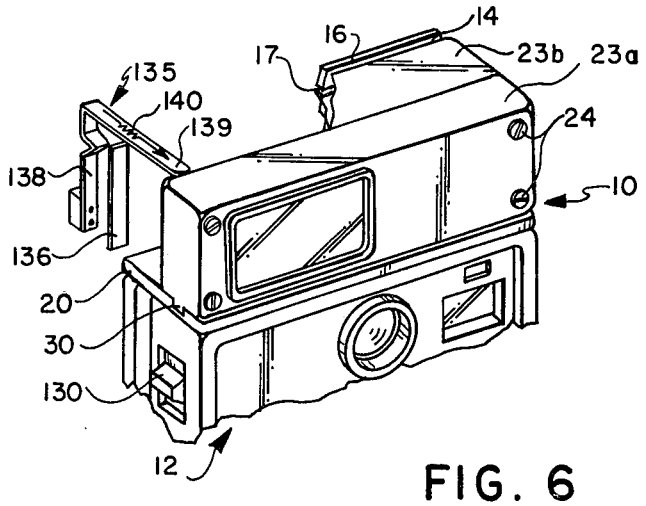
FIG. 6 is a perspective view of a portion of the camera and a portion of the flash unit showing a safety switch, in an open position, for deactivating the safety circuit of FIGS. 3 and 4.
Figure 7:
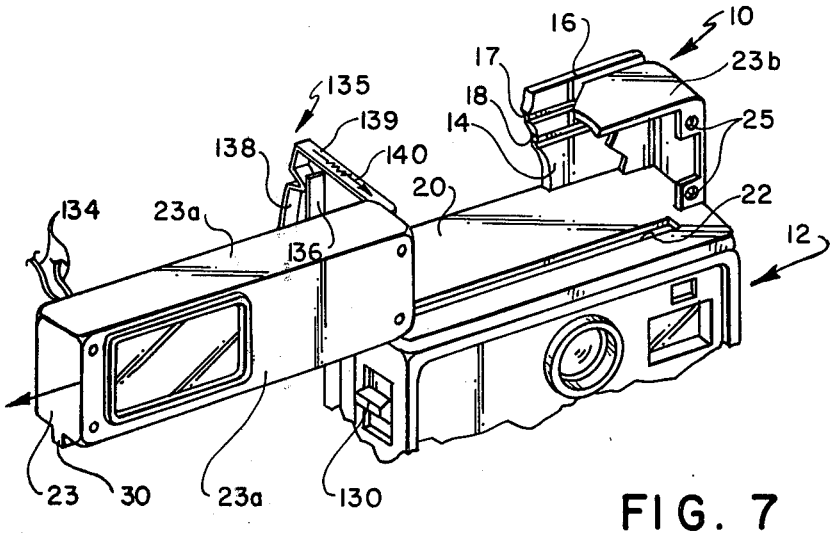
FIG. 7 is a view similar to the view of FIG. 6 only showing the safety switch in a closed position for activating the safety circuit.

Referring now to FIGS. 6 and 7, the safety switch 135 includes a conductive strip 136 and a conductive strip 138 located adjacent the strip 136. The supported end of the strip 136 is grounded. As shown schematically in FIG. 4, the strip 138 is connected to the quench trigger circuit 120 between the resistor 121 and the quench trigger capacitor 122. An elongate flash sensing lever 139, which preferably is made of an electrically insulating material, is connected to and projects at a right angle from the strip 138. The opposite end of the sensing lever 139 is adapted to abuttingly engage the inside of the front housing 23*a*. When the sensing lever 139 engages the housing 23*a* the free end of the strip 138 is displaced rearwardly, as viewed in the drawing, and is disengaged from the strip 136 whereby the switch 135 is in its open position. When the front housing 23*a* is separated from the rear housing 23*b* so that the sensing lever 139 no longer engages the front housing, the contact strip 138 moves forwardly under the influence of a spring 140, shown diagrammatically, to contact the strip 136, whereby the switch 135 is in its closed position.

As described previously herein, the flash unit 10 may be removed intact from the camera 12. If a flash operator were to remove the screws 24 and separate the front and rear housings after the flash unit 10 is removed from the camera 12, the switch 135 would close to discharge the firing capacitor 54.

The front housing 23*a* can be removed from the camera 12 while the rear housing 23*b* is attached to the camera, or vice versa, to close the switch 135. In either case, the capacitor 54 is discharged. When the screws 24 are removed, the front housing 23*a* is free to be slid to the left, as viewed in FIGS. 6 and 7, to be separated from the back housing 23*b*. When the front housing 23*a* is slid to an extreme position off the bracket member 14, as shown in FIG. 7, the sensing lever 139 is disengaged from the front housing. The strip 138 moves forwardly under the influence of the spring 140 to contact the strip 136, and the switch 135 closes.

The rear housing 23*b* can be removed from the camera 12 without removing the front housing 23*a* by inserting a card between the leg portion 16 and the housing 23*b* to flex the member 36 out of the groove 17. The rear housing 23*b* can then be slid to the left thereby allowing the safety switch 135 to close.

The quench circuit 69 is used both for quenching the flashtube 50, and for discharging the firing capacitor 54 for safety purposes. A bleeder resistor, as employed in the prior art to discharge the firing capacitor, is eliminated. Furthermore, the safety switch 135 need only be constructed to handle the discharge current of the quench trigger capacitor 122, and not the higher discharge current of the firing capacitor 54, as is the case with known prior art electronic flash safety circuits. Accordingly, the safety switch 135 need not be as large and expensive as prior art electronic flash safety switches.

The invention has been described in detail with reference to the Figures; however, it will be appreciated that variations and modifications are possible which are within the spirit and scope of the invention. For example, the quench tube 117 remains conductive, to discharge the firing capacitor 54, as long as the voltage on the firing capacitor is above a given level, approximately 30 volts. Accordingly, the entire voltage on the capacitor 54 does not discharge through the quench tube 117. Remaining voltage on the capacitor 54 can discharge through the resistor 121 and the switch 135, although discharge through the resistor 121 occurs at a rate that is slower than the rate that the capacitor 54 discharges through the quench tube 117.

Because energy stored on a capacitor is proportional to the square of its voltage, the energy remaining on the capacitor 54, when the quench tube 117 becomes nonconductive, is relatively small or only about 1 percent of maximum stored energy. This small amount of energy is not adequate to cause injury to a user. However, an SCR may be substituted for the quench tube 117 to quickly discharge all the voltage on the firing capacitor 54. The quench trigger circuit 124 would be modified so as to provide, in response to closing of the safety switch 135, a proper gate electrode voltage to such an SCR. The employment of an SCR to quench a flashtube is described in Research Disclosure Article No. 15939, published July 1977, the disclosure of which is incorporated herein by reference.

The control circuit 64 could be modified to produce a flash terminating signal related to an exposure parameter other than reflected scene light. For example, the circuit 64 could be in the form of a light-independent timing circuit in which its time constant is directly proportional to the distance between the camera and the subject being photographed. For short range subjects, the timing circuit would operate to more quickly quench the flash illumination than for long range subjects where additional flash illumination is needed.

What is claimed is:

1. In electronic flash apparatus having a flashtube energizable for illuminating a scene, and a dischargeable firing capacitor coupled to said flashtube for producing a discharge current to energize said flashtube, the improvement comprising:

(a) an energizable quench circuit coupled to said firing capacitor for diverting said discharge current from said flashtube, thereby terminating energization of said flashtube;

(b) a safety circuit including a switch coupled to said quench circuit, said switch having (1) a normal, deactuated condition, and (2) an actuated condition in which said quench circuit is energized by said safety circuit; and (c) a housing member movably associated with said switch and having (1) a first position in which said switch is maintained in its deactuated condition, and (2) a second position in which said switch is moved to its actuated condition, thereby energizing said quench circuit for discharging said firing capacitor.

2. In electronic flash apparatus having a flashtube energizable for illuminating a scene, and a dischargeable firing capacitor coupled to said flashtube for producing a discharge current to energize said flashtube, the improvement comprising:

(a) an energizable quench circuit coupled to said firing capacitor for diverting said discharge current from said flashtube, thereby terminating energization of said flashtube;

(b) control means coupled to said quench circuit for energizing said quench circuit in response to the occurrence of a predetermined exposure parameter;

(c) a safety circuit including a switch coupled to said quench circuit, said switch having (1) a normal, deactuated condition, and (2) an actuated condition in which said quench circuit is energized by said safety circuit independently of said control means; and (d) a housing member movably associated with said switch and having (1) a first position in which said switch is maintained in its deactuated condition, and (2) a second position in which said switch is moved to its actuated condition, thereby energizing said quench circuit for discharging said firing capacitor.

3. In electronic flash apparatus having a flashtube energizable for illuminating a scene, and a dischargeable firing capacitor coupled to said flashtube for producing a discharge current to energize said flashtube, the improvement comprising:

(a) an energizable quench circuit coupled to said firing capacitor for diverting said discharge current from said flashtube, thereby terminating energization of said flashtube;

(b) light-responsive means exposable to light and coupled to said quench circuit for energizing said quench circuit in response to the occurrence of a predetermined exposure condition;

(c) a safety circuit including a switch coupled to said quench circuit, said switch having (1) a normal, deactuated condition, and (2) an actuated condition in which said quench circuit is energized by said safety circuit independently of said light-responsive means; and (d) a housing member movably associated with said switch and having (1) a first position in which said switch is maintained in its deactuated condition, and (2) a second position in which said switch is moved to its actuated condition, thereby energizing said quench circuit for discharging said firing capacitor.

4. In electronic flash apparatus having a flashtube energizable for illuminating a scene, and a dischargeable firing capacitor coupled to said flashtube for producing a discharge current to energize said flashtube, the improvement comprising:

(a) a housing having a first housing portion detachably connected to a second housing portion;

(b) an energizable quench circuit, coupled to said firing capacitor, for diverting said discharge current from said flashtube in response to energization of said quench circuit, thereby terminating energization of said flashtube;

(c) a safety circuit including a switch coupled to said quench circuit said switch having (1) a normal deactuated condition, and (2) an actuated condition in which said quench circuit is energized by said safety circuit; and (d) a housing sensing member coupling said switch to said housing and having (1) a first position, when said first and second housing portions are connected, for maintaining said switch in its deactuated condition, and (2) a second position, when said front housing portion is detached from said second housing portion, for causing said switch to move to its actuated condition, thereby energizing said quench circuit for discharging said firing capacitor.

5. In electronic flash apparatus having a flashtube energizable for illuminating a scene, and a dischargeable firing capacitor coupled to said flashtube for producing a discharge current to energize said flashtube, the improvement comprising:

(a) a housing having a first housing portion detachably connected to a second housing portion;

(b) an energizable quench circuit, coupled to said firing capacitor, for diverting said discharge current from said flashtube in response to energization of said quench circuit, thereby terminating energization of said flashtube;

(c) control means coupled to said quench circuit for energizing said quench circuit in response to the occurrence of a predetermined exposure parameter;

(d) a safety circuit including a switch coupled to said quench circuit said switch having (1) a normal, deactuated condition, and (2) an actuated condition in which said quench circuit is energized by said safety circuit independently of said control means; and (e) a housing sensing member coupling said switch to said housing and having (1) a first position, when said first and second housing portions are connected, for maintaining said switch in its deactuated condition, and (2) a second position, when said front housing portion is detached from said second housing portion, for causing said switch to move to its actuated condition, thereby energizing said quench circuit for discharging said firing capacitor.

6. In electronic flash apparatus adapted to be removably mounted on a camera, said flash apparatus having a flashtube energizable for illuminating a scene, a dischargeable firing capacitor for producing a discharge current to energize said flashtube, and means for charging said firing capacitor from (1) a low energy state in which energy stored by said capacitor is inadequate to cause injury to a user, to (2) a high energy state in which energy stored by said capacitor is potentially harmful to a user, the improvement comprising:

(a) a housing having a first housing portion detachably connected to a second housing portion, said first and second housing portions being adapted to be removed separately from a mounted camera;

(b) quench circuit means, coupled to said firing capacitor, switchable between (1) a normal de-energized state for precluding discharge of said firing capacitor through said quench circuit means, and (2) an activatable energized state for discharging said firing capacitor through said quench circuit means; and (c) switch means coupled to (i) said housing, and (ii) said quench circuit means, said switch means having (1) a first condition for maintaining said quench circuit means in its normal de-energized state, and (2) a second condition for switching said quench circuit means from its de-energized state to its energized state, said switch means assuming said second condition in response to either said first housing portion or said second housing portion being removed from the camera, thereby energizing said quench circuit means for discharging said firing capacitor from said high energy state to said low energy state.

7. In electronic flash apparatus adapted to be removably mounted on a camera, said flash apparatus having a flashtube energizable for illuminating a scene, a dischargeable firing capacitor for producing a discharge current to energize said flashtube, and means for charging said firing capacitor from (1) a low energy state in which energy stored by said capacitor is inadequate to cause injury to a user, to (2) a high energy state in which energy stored by said capacitor is potentially harmful to a user, the improvement comprising:

(a) a housing having a first housing portion detachably connected to a second housing portion, said first and second housing portions being adapted to be removed separately from a mounted camera;

(b) quench circuit means, coupled to said firing capacitor, switchable between (1) a normal de-energized state for precluding discharge of said firing capacitor through said quench circuit means, and (2) an activatable energized state for discharging said firing capacitor through said quench circuit means;

(c) control means for producing a terminating signal in response to the occurrence of a predetermined exposure parameter; and (d) switch means coupled to (i) said control means, (ii) said housing, and (iii) said quench circuit means, said switch means having (1) a first condition for maintaining said quench circuit means in its normal de-energized state, and (2) a second condition for switching said quench circuit means from its de-energized state to its energized state, said switch means assuming said second condition either in response to (1) said terminating signal, or (2) either said first housing portion or said second housing portion being removed from the camera, thereby energizing said quench circuit means for discharging said firing capacitor from said high energy state to said low energy state.

8. In electronic flash apparatus adapted to be removably mounted on a camera, said flash apparatus having a flashtube energizable for illuminating a scene, a dischargeable firing capacitor for producing a discharge current to energize said flashtube, and means for charging said firing capacitor from (1) a low electrical energy state in which energy stored by said capacitor is insufficient to injure a user, to (2) a high electrical energy state in which energy stored by said capacitor is potentially harmful to a user, the improvement comprising:

(a) a housing having first and second portions detachably connectable to a camera;

(b) quench circuit means, coupled to said firing capacitor, switchable between (1) a normal de-energized state for precluding discharge of said firing capacitor through said quench circuit means, and (2) an activatable energized state for discharging said firing capacitor through said quench circuit means; and (c) switch means, coupled to (i) said housing, and (ii) said quench circuit means, having (1) a first condition for maintaining said quench circuit means in its normal de-energized state, and (2) a second condition for switching said quench circuit means from its de-energized state to its energized state, said switch means engaging said housing and responsive to removal of either said first housing portion or said second housing portion from the camera, for switching said switch means from its first condition to its second condition, thereby energizing said quench circuit means for discharging said firing capacitor from said high energy state to said low energy state.

9. In electronic flash apparatus adapted to be removably mounted on a camera, said flash apparatus having a flashtube energizable for illuminating a scene, a dischargeable firing capacitor for producing a discharge current to energize said flashtube, and means for charging said firing capacitor from (1) a low electrical energy state in which energy stored by said capacitor is insufficient to injure a user, to (2) a high electrical energy state in which energy stored by said capacitor is potentially harmful to a user, the improvement comprising:

(a) a housing having first and second portions detachably connectable to a camera;

(b) quench circuit means, coupled to said firing capacitor, switchable between (1) a normal de-energized state for precluding discharge of said firing capacitor through said quench circuit means, and (2) an activatable energized state for discharging said firing capacitor through said quench circuit means;

(c) light-responsive integrating circuit means exposable to light for producing a terminating signal in response to the occurrence of a predetermined exposure condition; and (d) switch means, coupled to (i) said housing, (ii) said integrating circuit means, and (iii) said quench circuit means, having (1) a first condition for maintaining said quench circuit means in its normal de-energized state, and (2) a second condition for switching said quench circuit means from its de-energized state to its energized state, said switch means including (i) first electronic switch means connected to said integrating circuit means and responsive to said terminating signal for switching said switch means from its first condition to its second condition, and (ii) second mechanical switch means, engaging said housing and responsive to removal of either said first housing portion or said second housing portion from the camera, for switching said switch means from its first condition to its second condition, thereby energizing said quench circuit means for discharging said firing capacitor from said high energy state to said low energy state.

* * * * *